US005542352A

United States Patent [19]

Blackman et al.

[11] Patent Number: 5,542,352

[45] Date of Patent: Aug. 6, 1996

[54] METHOD AND APPARATUS FOR CLEANING STATIONARY AND MOVING PRINTING PRESS COMPONENTS

[75] Inventors: Daniel S. Blackman, Lancaster; Richard D. Warner, Clinton; Lloyd P. DeJidas; Gary A. Jones, both of Pittsburgh, all of Pa.

[73] Assignee: Graphic Arts Technical Foundation, Pittsburgh, Pa.

[21] Appl. No.: 331,117

[22] Filed: Oct. 28, 1994

[51] Int. Cl.[6] ..... B41M 1/00

[52] U.S. Cl. ..... 101/483; 101/423; 15/231; 15/210.1

[58] Field of Search ..... 101/483, 423, 101/424, 425; 15/231, 232, 229.13, 210.1

[56] References Cited

U.S. PATENT DOCUMENTS

| | | | |
|---|---|---|---|
| 804,794 | 11/1905 | Coan | 15/231 |
| 1,118,546 | 11/1914 | Goodwin | 15/231 |
| 2,156,494 | 5/1939 | Goodloe | 15/209 |
| 2,203,728 | 6/1940 | Hutchinson | 15/231 |
| 2,219,000 | 10/1940 | Williams | 15/231 |
| 2,364,319 | 12/1944 | Schimel | 15/229.13 |
| 2,456,782 | 12/1948 | Hartman | 15/231 |
| 2,472,403 | 1/1949 | Burwen | 15/209 |
| 2,554,734 | 5/1951 | Gehm | 15/231 |
| 2,885,707 | 5/1959 | Vogt | 15/229.13 |
| 2,958,146 | 11/1960 | Van Dusen, Jr., et al. | 41/9 |
| 3,751,752 | 8/1973 | Krusche et al. | 15/231 |
| 4,926,522 | 5/1990 | Wang | 15/144.1 |

*Primary Examiner*—Edgar S. Burr
*Assistant Examiner*—Anthony H. Nguyen
*Attorney, Agent, or Firm*—Price & Adams

[57] ABSTRACT

A shop towel is wrapped around a retainer having a base with a ratchet bar extending upwardly from one surface of the retainer base. The ratchet bar extends into a recess of a handle of a body portion having a contoured surface for receiving at one end the retainer and at the opposite end the hand of an operator. The ratchet bar is advanced into engagement with a spring actuated-pawl that extends transversely through the handle body portion. The pawl is axially movable in the handle and maintained by a spring in engagement with the ratchet bar. The ratchet bar is freely advanced into the recess and engaged by the pawl to maintain the retainer movably connected to the handle body portion. The engagement of the pawl with the ratchet bar prevents the retainer from being inadvertently disconnected from the handle until the pawl is pulled by a lever out of contact with the ratchet bar. The retainer is advanced into the handle body portion without requiring rotation of the retainer or the use of tools to frictionally engage the shop towel between the retainer and handle body portion. The retainer has an expanded surface area to shield the operator's hand from contact with the shop towel. The handheld device with the attached shop towel containing a cleaning solution is traversed back and forth the length of a rotating press cylinder to apply the cleaning solution to the surface of the cylinder rotating at a controlled speed. Following the cleaning operation, the shop towel is replaced with a dry towel which is securely clamped in place on the retainer to dry the cylinder.

16 Claims, 4 Drawing Sheets

METHOD AND APPARATUS FOR CLEANING STATIONARY AND MOVING PRINTING PRESS COMPONENTS

BACKGROUND OF THE INVENTION

1. Field of the Invention

This invention relates to method and apparatus for cleaning the components of moving machinery, such as printing press cylinders, and more particularly to a handheld device that permits conventional shop towels to be safely used in cleaning moving cylinders of a press.

2. Description of the Prior Art

The operation of a printing press requires periodic servicing which may be performed during normal production operations. The servicing of printing presses is regulated by the Occupational Safety And Health Administration (OSHA) as set forth in 29 C.F.R. § 1910.147, 1910.212, and 1910.219. These regulations apply to printing presses which function under two separate modes of operation. One operational mode occurs when the equipment is used in normal production operations, and the OSHA standards on machine guarding apply. The other mode occurs when the equipment is being serviced and maintained, and the OSHA standard on the control hazardous energy (lockout-tagout) at 29 C.F.R. § 1910.147 applies.

The OSHA safety standards for printing presses require safeguarding the machines and equipment to preclude operator injury during normal production operations, that is, when a machine or piece of equipment is being used to perform its intended production function. In addition the OSHA standard for the control for hazardous energy (lockout/tagout) requires the safeguarding of machines and equipment whenever servicing or maintenance is being performed. This safeguarding normally consists of stopping the machine or equipment, isolating it from its energy source(s), locking or tagging out the energy isolating devices, relieving or releasing any stored or residual energy and then verifying that the machine or piece of equipment is safe to work on. All safeguarding activities must be conducted in accordance with procedures developed and documented by the employer for the purpose.

The OSHA safety standards recognize that some minor servicing, that is, servicing which must be conducted frequently, may have to be performed during normal production operations, and a lockout/tagout exception is allowed. The exception is set forth in 29 C.F.R. § 1910.147 (a) (2) (ii) and states as follows:

> Minor tool changes and adjustments, and other minor servicing activities, which take place during normal production operations, are not covered by this standard if they are routine, repetitive, and integral to the use of the equipment for production, provided that the work is performed using alternative measures which provide the effective protection.

In the printing industry it is understood that the term "minor servicing" includes, among others, tasks such as cleaning of certain types of paper jams; minor cleaning, lubricating and adjusting operations; certain plate and blanket changing tasks; and, in some cases, paper webbing and paper roll changing. Generally, "minor servicing" is considered to include those tasks involving operations which can be safely accomplished and where extensive disassembly of equipment is not required.

In order to perform maintenance or servicing, in which an operator bypasses guards which are required by either 29 C.F.R. § 1910.212 or 29 C.F.R. § 1910.219, or otherwise becomes exposed to the hazards of machine start-up or to the unexpected release of hazardous energy, the OSHA lockout/tagout standards apply. If no such exposure occurs (either because of the methods in which the minor servicing is performed or because special tools, techniques or other protection is used), lockout/tagout is not required provided the operator uses alternative measures which enable an operator minor servicing without being exposed to a hazard. Under no circumstances is an operator ever permitted to place any part of his or her body within a hazardous area, such as the point of operation, while the equipment is running or energized or around power transmission apparatus.

During minor servicing, an operator is considered to have met the requirement for providing the effective alternative protection by the use of special tools or techniques. The effective alternative protection may not include, by themselves, simple pushbuttons, selector switches and other control circuit type devices which lack a control logic, such as an interlocked arrangement which provides a single operator with exclusive control.

One method which offers effective alternative protection is the inch-safe-service technique used for the main drive control. This technique is constant with the use of controls specified in the standard required for web and sheet fed printing presses and binding and finishing equipment respectively for which, as a minimum, a stop/safe/ready function must be available at designated control stations. Limiting some control stations to the "inch" function only is not permitted. Also, the stop/safe/ready switch must not serve as the lockout disconnect when lockout is performed. The essential elements of this procedure are as follows:

1. Before any minor servicing is performed, the machine must be stopped and its drive control must be on STOP/SAFE position. Servicing and/or maintenance as defined in 29 C.F.R. § 1910.147 (b) must not be conducted when the components of the machine are moving.
2. Consistent with the requirements contained in 29 C.F.R. § 1910.147 (f) (1) for testing or positioning a machine during servicing, procedures to inch a machine require all operating personnel be positioned so that they are not endangered by the reenergization or start-up of the machine. In addition, all tools or other implements used during the servicing must be positioned so that no hazard is created by operating personnel. On presses attended by more than one operator or when it is possible for other personnel to enter the frame or be obscured from view of the operator, suitable safety alerting signals must be provided.
3. By use of the INCH control, the components of the machine are moved to their desired position. Immediately thereafter the drive control is placed on SAFE by each operator working in a hazardous area before beginning or resuming the minor servicing.
4. Steps 2 and 3 above are repeated as necessary until the minor servicing is completed.

When minor servicing is conducted and the use of the STOP/SAFE drive control is the method of safeguarding operating personnel, the controls to make READY, to INCH, and to START the machine must be under the exclusive control of the authorized person(s) who is/are performing the servicing. If there is a likelihood that the START or INCH controls can be inadvertently activated by any operating personnel, including the one performing the minor servicing, it is necessary that the permissive period be immediately canceled by depressing the STOP/SAFE push-button, and not wait for the conclusion of the permissive period to conduct the minor servicing. The STOP/SAFE control used for the inch-safe-service procedure shall be designed and installed to preclude energization or start-up of the equipment by any other control until all SAFE's are canceled.

When more than one individual performs a particular servicing or maintenance operation on a machine or equipment, the servicing or maintenance generally is not considered minor in nature and the machine or equipment must be locked out or tagged out in accordance with 29 C.F.R. § 1910.147. However, if two or more operating personnel perform separate servicing operations on a machine or equipment at the same time, the combined servicing operation may be considered minor servicing only when each separate servicing operation is routine, repetitive, and integral to normal production operations and when alternative effective protection is provided for the servicing personnel. Alternative effective protection means:

1. Servicing is conducted when the machine or equipment is stopped.
2. Each servicing employee has continuous, exclusive control of the means to start the machine or equipment.
3. Safeguarding is provided to each servicing personnel to prevent exposure from the release of harmful, stored, or residual energy.

It is consistent with OSHA standards for printing presses that minor servicing operations that include clearing certain types of paper jams; minor cleaning, lubricating and adjusting operations; certain blanket and blanket-changing tasks; and in some cases, paper webbing and paper roll changing can be accomplished using the inch-safe-service-method, where the safety practice inherent under conditions of normal production operations prevail.

The cleaning of the blanket cylinder of a printing press must comply with the OSHA standard for lockout/tagout (29 C.F.R. § 1910.147) or the machine guarding standards in Sub-part O of 29 C.F.R. § 1910. The standards for "blanket cleaning" activities require that blanket cleaning be performed only on the cut-running sides of the rolls. Rigid finger guards are required so that fingers will be prevented from being drawn into any in-going nip points or otherwise be injured. Mechanical transmission components can not be exposed in the area where "blanket washing" is performed. Live electrical parts cannot be exposed in the area where "blanket washing" is performed. Any tools that are used to clean a blanket cylinder cannot be forced away or thrown back from the blanket cylinder when an operator is using it for "blanket cleaning" activities. Cleaning tools must be designed so that no part of the operator's body can be trapped between the tool and the moving machinery. Rags used to clean the cylinder cannot be drawn into the moving machinery. An operator can not wear any clothing or jewelry or wear their hair in a manner that can be drawn into the moving machinery.

It has been the conventional practice to clean press cylinders with a shop towel wetted with a cleaning solution. The cylinders are wiped clean with the wet towel and thereafter wiped dry with a separate clean towel. Cleaning and drying press cylinders by hand require the application of the OSHA lockout/tagout standards in which the cylinders can out be rotating as they are cleaned and the operator is protected from exposure to the hazards of machine start-up or to the unexpected release of hazardous energy. However, as pointed out above when special tools or other techniques are used the lockout/tagout procedures are not required for performing minor servicing, and in such instances the press operator can safely clean the rotating parts while the press is operating in the "inch" function.

There is need for a device that will permit a machine operator to safely clean press cylinders operating at a controlled speed for servicing, for example at crawl or inch speed, and other moving machine components in compliance with OSHA standards using conventional cleaning materials, such as reusable shop towels and cleaning solutions. While automatic blanket washers are known they are very expensive, and in many instances it is preferred to use conventional cleaning materials. However, as pointed out above conventional cleaning materials cannot be used unless the cylinders are operated under the lockout/tagout procedures. Therefore, there is need for a handheld device that permits the use of conventional shop towels and cleaning solutions for servicing moving parts of a printing press operating at a controlled speed for servicing which speed is less than production speed. The cleaning operation should be performed without requiring that the press operation be interrupted.

With the advent of "wipe-on" and "presensitized" lithographic printing plates, it is known to use handheld chemical applicators composed of a handle and sponge to prepare plates for imaging. Chemical applicators of this type are suited for plate preparation but not for cleaning rotating press components. The sponge applicator cannot adequately remove inks, varnishes, coatings, and other production materials from the press components or dry the components.

Handheld devices for supporting cleaning, scouring, and polishing pads are well know in the art. Generally these devices include a handle portion connected to a body portion having a planar surface that receives in clamping engagement by fastening means and the like a plate or retaining member for supporting cleaning, scouring, or polishing material. The material is wrapped around the retaining member and when the retaining member is secured by the fastening means to the body the material is clamped between the opposed surfaces of the retainer and the body portion to securely hold it in place. Once the material is consumed in use it is replaced by disconnecting the retainer from the handle and new material is installed.

Examples of known handheld cleaning and polishing devices are disclosed in U.S. Pat. Nos. 804,794; 1,118,546; 2,203,728; 2,156,494; 2,456,782; 2,472,403; British Patent No. 531,282 and French Patent No. 1,023,787. With each of these devices the material used for cleaning, scouring, or polishing is a fabric material selected from cloth, steel wool, resilient pad, or metallic mesh.

It is also known, as disclosed in U.S. Pat. No. 2,958,146, to use a handheld applicator for applying an etch solution to lithographic printing plates. A tricot-knitted fabric is supported by a foam rubber backing member retained in a casing. The fabric is wrapped about the foam rubber backing material. The backing material is connected to the casing to clamp the fabric therebetween and around the exposed surface of the backing material. In use a handle is gripped, and the fabric is dipped in an etch solution where the sponge causes the solution to be soaked up. The applicator is then pressed against the lithographic plate to transfer the etch solution from the fabric to the plate.

While the known handheld cleaning and polishing devices teach the removable connection of cleaning fabric between a base and handle portion, the known devices require that the handle and base be connected by screws or other devices which require tools for their engagement and disengagement or at least hand rotation of the connecting parts to secure the fabric in place. With the known devices the operator's hand is moved from contact with the cleaning or etch solution. In an addition the base or retainer for the fabric material serves as a guard to maintain the operator's hand removed from the surface being treated.

There is need for a handheld device in the cleaning of printing press components that allows the use of conventional shop towels. The use of shop towels to clean printing presses is substantially less expensive than automatic cleaning devices and is still a preferred method for cleaning moving and stationary press components. However, in order to efficiently clean the components of a printing press, it is preferred that the press components remain moving so that the entire press is not shut down during the period when minor servicing is performed.

OSHA standards permit the press to operate in the "inch" function. However for shop towels to be used without requiring lockout/tagout of the press, the towel must be supported on a device that removes the hand from contact with the moving parts. The known handheld devices do not facilitate efficient installation and replacement of the shop towel while meeting the other OSHA requirements allowing moving press components to be cleaned. A handheld cleaning device that meets OSHA standards and at the same time provides maximum efficiency in the cleaning of stationary and moving press components would facilitate press cleaning operations.

SUMMARY OF THE INVENTION

In accordance with the present invention there is provided handheld apparatus for supporting fabric material that includes a body portion having at one end a handle and at an opposite end an enlarged bearing surface for engaging fabric material. A retainer member is positioned oppositely of the bearing surface and has a peripheral surface for supporting the fabric material wrapped around the supporting surface. A bar is immovably secured to and extends outwardly from the retained member. An internal recess extends through the bearing surface into the body portion to receive the bar for non-rotational longitudinal movement of the retainer member toward and away from the bearing surface. Locking means extends through the handle into engagement with the bar for restraining movement of the bar out of the recess. The locking means is movable into and out of engagement with the bar to permit intermittent advance of the bar into the recess while preventing movement of the bar out of the recess to position the retainer member with a layer of the fabric material wrapped around the peripheral surface into clamping engagement with the body portion bearing surface to secure the fabric material to the body portion. Means is provided for releasing the locking means from engagement with the bar to allow extension of the bar from the recess to permit removal of the fabric material from clamping engagement with the body portion.

Further in accordance with the present invention there is provided a method for releasably supporting a fabric material on a handheld device that includes the steps of positioning a retainer member oppositely of a bearing surface of a base of a handle member. Fabric material is wrapped around the retainer member to cover the retainer member. The retainer member is supported on the handle member for non-rotational movement of the retainer member toward and away from the base bearing surface. The retainer member is engaged on the handle to restrain movement of the retainer member in a first direction away from the handle member while permitting movement of the retainer member in a second direction toward the handle member. The retainer member is intermittently advanced to selected positions opposite the base bearing surface. The retainer member is locked in selected positions opposite the base bearing surface. The retainer member is advanced with the fabric material wrapped therearound into contact with the base bearing surface to clamp the fabric material between the retainer member and the base bearing surface to secure the fabric material to the handle member. The retainer member is released from locking engagement with the base to permit removal and replacement of the fabric material on the retainer member.

Further in accordance with the present invention there is provided a method for cleaning a rotating cylinder of a printing press that includes the steps of wrapping cleaning fabric around a body portion having a peripheral surface for receiving and supporting the cleaning fabric. The body portion is positioned with the cleaning fabric wrapped therearound opposite a handheld support member. The body portion is secured in engagement with the support member. The body portion is intermittently, nonrotatably advanced toward the support member into successive locked positions on the support member. The body portion is restrained from movement away from and out of engagement with the support member. The body portion is moved to a position opposite the support member where the cleaning fabric is frictionally engaged between the body portion and the support member so that the cleaning fabric is securely clamped to the body portion and the support member. A cleaning solution is applied to the cleaning fabric wrapped around the body portion. The support member is held to position the cleaning fabric wrapped around the body portion oppositely of a printing press cylinder rotating at a preselected speed. The cleaning fabric is placed in contact with the surface of the rotating cylinder. The support member is moved along the longitudinal length of the rotating cylinder while maintaining the fabric in contact with the rotating cylinder. The support member is traversed in a back and forth motion between opposite ends of the cylinder to transfer the cleaning solution from the cleaning fabric to the surface of the cylinder as the cylinder rotates at the preselected speed.

Accordingly, a principal object of the present invention is to provide method and apparatus for safely cleaning the stationary and moving components of a printing press using conventional fabric cleaning materials and protecting the operator from risk of injury.

Another object of the present invention is to provide a handheld device that supports cleaning material for use in the maintenance of cylinders of a printing press where the cleaning material is easily secured and removed from the device and the operator's hand is maintained removed from contact with the moving press components.

Another object of the present invention is to provide a handheld device that permits conventional shop towels to be used in cleaning the printing press cylinders rotating at a preselected speed where the towel is easily clamped into position on the device, including provisions for protecting the operator from injury during the cleaning operation.

An additional object of the present invention is to provide a method for cleaning the cylinders of a printing press while the cylinders are rotating at creep, crawl, or inch speed using conventional, reusable shop towels and cleaning solutions.

These and other objects of the present invention will be more completely disclosed and described in the following specification, accompanying drawings, and appended claims.

DESCRIPTION OF THE PREFERRED EMBODIMENTS

Figure 1:
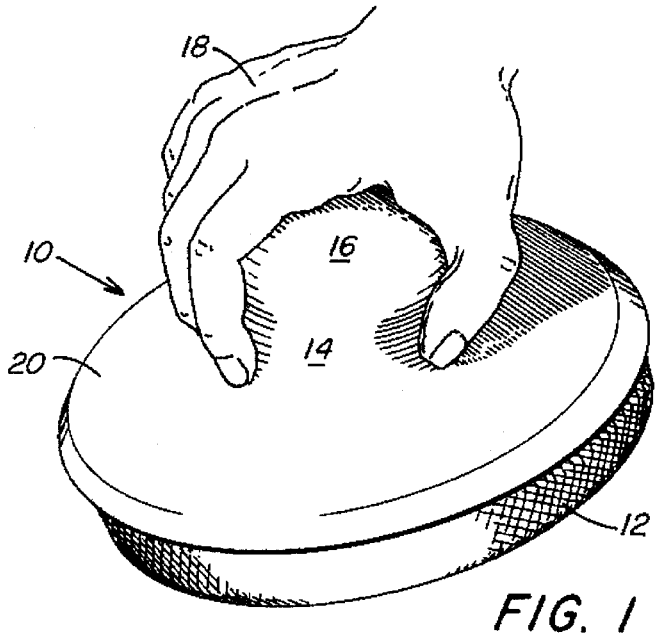
FIG. 1 is a schematic illustration of a handheld device for cleaning moving components of machinery, using conventional fabric material secured to the handheld device.
Figure 2:
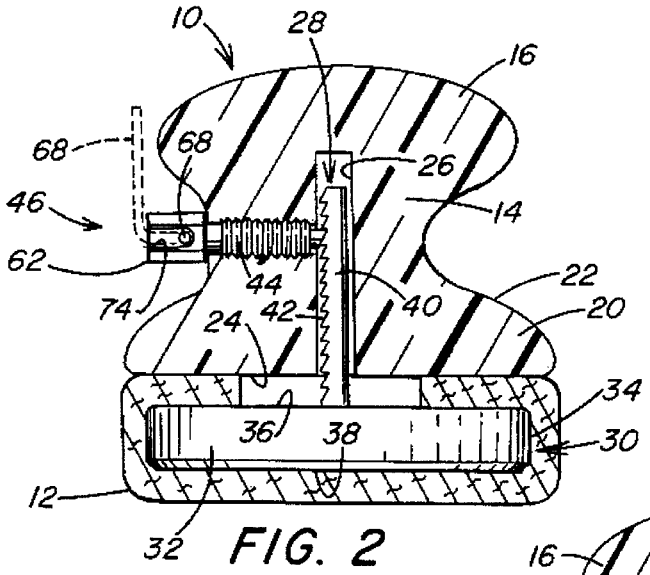
FIG. 2 is a sectional view in side elevation of the handheld cleaning device, illustrating fabric material clamped in place by a ratchet and pawl mechanism.
Figure 3:
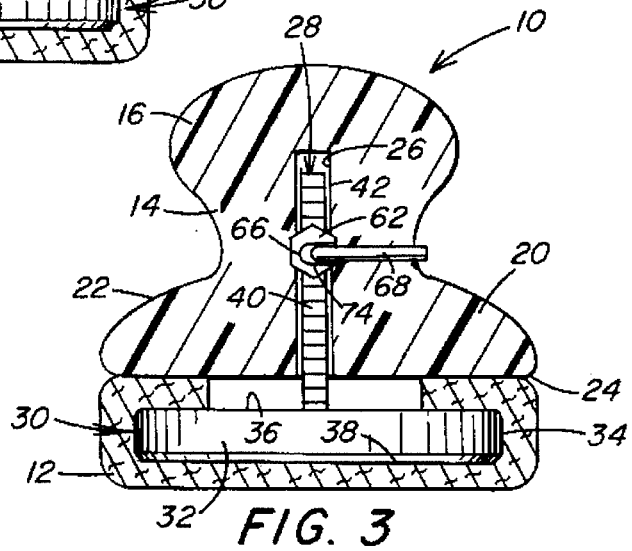
FIG. 3 is a front sectional view of the handheld device shown in FIG. 2, illustrating the mechanism for securely clamping the fabric material in place on the device.

Referring to the drawings and particularly to FIGS. 1–3, there is illustrated a handheld device generally designated by the numeral 10 for the use in supporting selected fabric or cloth-like material 12 in position for performing a variety of manual operations that include cleaning, wiping, scouring, polishing, abrading, and the like to a wide variety of objects having a planar or contoured surface requiring treatment by contact with the fabric material 12. The device 10 includes a contoured body portion 14 fabricated of selected material, such as wood, metal, plastic or the like. The body portion 14 includes at one end portion a handle 16 having a contoured surface merging with the body portion 14 to permit ease of grasping by a hand 18 of an operator.

The body portion 14 of the handheld device 10 flares or expands outwardly at an opposite end from the handle 16 to form a base member 20. The base member 20 has an arcuate surface 22 that serves as a shield or a guard to protect the operator's hand 18 grasping the handle 16. The handle 16 has a contour that permits it to be easily gripped by the operator's hand 18.

The base member arcuate surface 22 prevents the operator's hand 18 from extending beyond the handle 16. The base member 20 includes a substantially planar bearing surface 24 of a desired configuration, such as oval, circular, rectangular, square, or any other shape as desired. Extending through the bearing surface 24 and positioned centrally of the body portion 14 is an elongated recess 26 for receiving a locking mechanism generally designated by the numeral 28.

Positioned oppositely of the body portion bearing surface 24 is a retainer generally designated by the numeral 30 for the fabric material 12. The retainer 30 also includes a body portion 32 having a configuration complementary to the planar shape of the bearing surface 24. The retainer body portion 32 has a contoured peripheral surface 34 adapted to receive the fabric material 12 which is wrapped around the retainer 30 as shown in FIGS. 2 and 3. The sequence for positioning the fabric material 12, such as a reusable shop towel used in cleaning printing press cylinders, is shown in FIGS. 9–12 and will be explained later in greater detail. Preferably, the retainer 30 includes planar surfaces 36 and 38 with the surface 36 positioned oppositely of the body portion bearing surface 24 when the retainer 30 is connected to the handle body portion 32.

The retainer 30 is connected to a locking bar 40 which is part of the locking mechanism 28. The bar 40 is securely anchored at one end portion to extend upwardly from the retainer surface 36. Preferably the locking bar 40 is a ratchet bar having a series of ratchet teeth 42 extending in series the length of the bar 40. The bar 40 has a width that is less than the width of the recess 26 in the handle body portion 32. The ratchet bar 40 has a length at least the length of the recess 26 and may exceed slightly the length of the recess 26. With this arrangement the ratchet bar 40 with the retainer 30 attached thereto is easily moved into and out of the recess 26.

The handle body portion 14 includes a passageway 44 that extends through the body portion 14 perpendicular to the elongated recess 26. The passageway 44 has an opening in the arcuate surface 22 at one end and at the opposite end opens into and intersects with the recess 26. An actuator 46 of the locking mechanism 28 is retained for longitudinal movement in the passageway 44 into and out of locking engagement with the locking bar 40. The actuator 46 is releasably engagable with the locking bar 40 to permit unrestrained advancement of the bar 40 into the recess 26.

As the bar 40 is advanced into the recess 26 it is engaged by the actuator 46. The bar 40 is advanced to position the retainer 30 is in a preselected position opposite the body portion 14. The advance of the retainer 30 toward the body portion 14 may be intermittent, that is, successively moved from one position to the next where in each position the retainer 30 is locked in place to securely position the retainer surface 36 a preselected distance from the bearing surface 24. The locking mechanism 28 facilitates intermittent advance of the retainer 30 toward the body portion 14 and permits the retainer 30 to be advanced in one continuous movement to where the retainer is positioned as closely as possible to the body portion 14.

While the retainer 30 is movable freely toward the body portion 14 by advancement of the locking bar 40 into the recess 26, the actuator 46 prevents movement of the retainer 30 away from the body portion 14. In other words, when advance of the locking bar 40 into the recess 26 is interrupted, the actuator 46 engages the bar 40. This prevents the locking bar 40 from moving under the force of gravity out of the recess 26.

The locking bar 40 is freely movable into the recess 26 but is restrained from moving freely out of the recess 26 or away from the body portion 14 until the actuator 46 is manually released from engagement with the locking bar 40. In this manner the fabric material 12 is securely clamped on the retainer 30 between the retainer 30 and body portion 14 in one continuous motion without the use of tools or rotational movement of retainer 30 or body portion 14.

Figure 7:
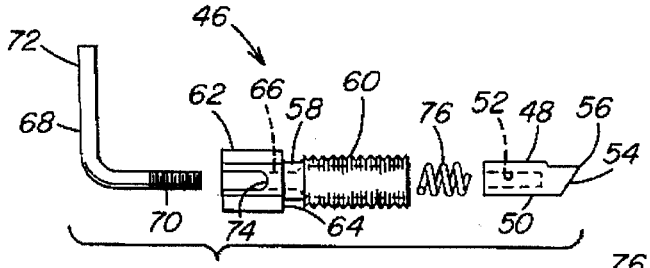
FIG. 7 is an exploded view in side elevation of the spring actuated pawl for locking the cloth supporting surface in position on the handle.
Figure 8:
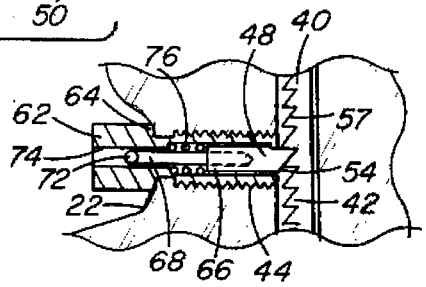
FIG. 8 is a fragmentary sectional view in side elevation of the ratchet and pawl mechanism for the handheld cleaning device.

Now referring to FIGS. 7 and 8, there is illustrated in greater detail the components of the actuator 46 in FIG. 7 and the actuator 46 engaging the locking bar 40 in FIG. 8. Preferably, the locking bar 40 includes a longitudinal configuration of ratchet teeth 42. The actuator 46 includes a spring actuated pawl 48. The pawl 48 includes a shaft portion 50 having an internally threaded bore 52 extending through one end portion and an angled or inclined edge 54 at the opposite end portion. The angled edge 54 includes an extended point 56.

Each tooth 42 of the ratchet bar 40 has an inclined surface 57 for receiving the pawl inclined edge 54. The configuration of the inclined edge 54 is complementary to the inclined surface 57 extending between teeth 42. Thus the pawl 48 seats, on the surface 57 between any one of the ratchet teeth 42. The mating surfaces 54 and 57 permit movement of the bar 40 into the recess 26 for selective positions of the retainer 30 on the handle body portion 14 but restrain movement of the bar 40 out of the recess 26. The actuator 46 must be manually released to permit movement of the bar 40 out of the recess 26.

The shaft end 50 of the pawl 48 is movably retained within one end of a housing 58. An exterior threaded portion 60 of housing 58 is threadedly engaged to internally threaded passageway 44 extending through the body portion 14. The housing 58 includes an enlarged end portion 62 that is restrained, as seen in FIG. 8, by abutting engagement of a shoulder 64 with the surface 22 of the body portion 14 from advancing into the passageway 44.

The housing 58 includes an axle bore 66 (FIG. 7) that extends the length of the housing 58 . The pawl 48 is axially movable in one end of the bore 66, and a lever 68 extends through the enlarged end portion 62 into the bore 66. A threaded end portion 70 of the lever 68 extends perpendicular to a shaft end portion 72 of lever 68. The housing enlarged end portion 62 includes a slot 74 that extends through the surface of the end portion 62 into the bore 66.

An actuator spring 76 is positioned within the housing bore 66 in surrounding relation with the lever 68 in the bore 66. The lever end portion 72 extends out of the bore 66 and upwardly through the slot 74. With the spring 76 positioned in the housing bore 66 as shown in FIG. 8, one end of the spring 76 abuts an internal shoulder of the housing end portion 62. An opposite end of the spring 76 abuts the end of the pawl 48 connected to the lever end portion 70.

The actuator spring 76 is compressed between the enlarged end portion 62 and the pawl 48. This normally urges the pawl 50 into engagement with the ratchet teeth 42. The spring 76 exerts a force on the pawl 48 so that the inclined surface 54 of the pawl 48 positively seats on inclined surface 57 between the ratchet teeth 42.

In operation the spring actuated pawl 48 is movable into and out of engagement with the teeth 42 of the ratchet bar 40 to permit intermittent advance of the bar 40 into the recess 26. This allows the retainer 30 to be nonrotatably and linearly advanced into engagement with the handle body portion 14. Thus no rotation of the ratchet bar 40 or the retainer 30 is required to advance the retainer 30 toward the handle body portion 14. The spring 76 normally maintains the pawl 48 in contact with the ratchet bar 40 so that the pawl inclined surface 54 engages the ratchet teeth 42. The inclined surfaces 54 and 57 remain in abutting relation.

With the surfaces 54 and 57 in abutting relation when the bar 40 is advanced into the recess 26, the bar 40 advances tooth by tooth into and out of engagement with the pawl 48. In other words, as inward pressure is placed on the ratchet bar 40, the pawl 48 is pressed backward against the action of the spring 76 to permit the bar to advance into the recess 26. Thus the pawl 48 engages and releases the ratchet teeth 42 as the bar 40 is advanced into the recess 26.

At any point where movement of the bar 40 in the recess 26 is stopped the spring 76 urges the pawl 48 into seating engagement with the ratchet teeth 42. The ratchet bar 40 is then locked into position in the handle 16. The retainer 30 is maintained in handle 16 in a preselected position opposite the body portion 14. The ratchet bar 40 is restrained by engagement of the pawl 48 with the ratchet teeth 42 from moving in a direction out of the recess 26 when a force is applied to the retainer 30 to move it away from the body portion 14. Unless the pawl 48 is moved axially in the housing 58 away from the ratchet bar 40, the pawl 48 remains engaged with the ratchet teeth 42.

To release the pawl 48 from the engagement with the ratchet teeth 42, the lever end portion 72 is pulled backward to move the pawl 48 out of engagement with the ratchet bar teeth 42 so that movement of the ratchet bar 40 out of the recess 26 is unobstructed. The lever 68 is pulled away from the handle 16 so that the spring 76 is compressed between the end of the pawl 48 and the internal shoulder of the housing enlarged end portion 62. The lever 68 is pulled backward until the lever end portion 72 has moved out of the slot 74.

When the pawl 48 is disengaged from the ratchet bar 42, the ratchet bar 42 is freely movable out of the handle body portion 14. To lock the lever 68 in a position maintaining the pawl 48 disengaged from the ratchet bar 40, the lever end portion 72 is rotated through 90° out of the bore 66 to a position abutting the enlarged end portion 62. In this position of the lever 68 as shown in phantom in FIG. 2, the spring 76 is maintained compressed between the housing enlarged end portion 62 and the pawl 48. The pawl 48 is removed from engagement with the ratchet teeth 42. Then rotating the lever end portion 72 90° to a position aligned with the slot 74 and releasing the lever, permits the lever 68 to move under the action of the spring 76 to force the pawl 48 into engagement with the ratchet teeth 42.

With the locking mechanism 28 of the present invention the retainer 30 is easily moved toward and away from the handle 16 to locate the retainer 30 a preselected distance from the handle body portion 14. The ratchet and pawl mechanism 28 permits an uninterrupted, continuous advance of the retainer 30 into engagement with the body portion 14. Also, the retainer 30 can be advanced intermittently to selected positions as the pawl 48 releases and engages successive ratchet teeth 42. However, the retainer 30 cannot be moved from or fall out of the recess 26 without pulling the lever end portion 72 out of the housing 66 to lock the pawl 48 against the action of the spring 76. This prevents the retainer 30 from falling out of the handle body portion 14.

The positioning of the retainer 30 relative to the handle body portion 14 is accomplished by the provision of the ratchet and pawl mechanism 28 without rotational movement of either the retainer 30 or the handle 16. In addition, no tools are required to move the retainer 30 into and out of engagement with the handle portion 14. This overcomes the inconvenience of known handheld devices which require fasteners to be rotated to engage and disengage the members or tools to be used to tighten or loosen the members for relative movement.

With the present invention the engagement and disengagement of the retainer 30 with the handle 16 is efficiently accomplished. The retainer 30 is quickly connected to the handle body portion 14. Once connected the retainer 30 is easily adjusted to a position on the handle body portion 14. This makes operation of the handheld device 10 much more efficient for cleaning, polishing, or treating a surface by the fabric material 12 clamped onto the retainer 30.

As illustrated in FIGS. 2 and 3 the fabric material 12 is wrapped around the peripheral surface 34 of the retainer 30. The material 12 completely covers the retainer surface 38 and substantially all of the planar surface 36 positioned oppositely of the bearing surface 24 of the handle body portion 14. As indicated above, the fabric material 12 is selected to meet the needs of the operation performed by the handheld device 10. For example, when the device 10 is used to clean surfaces, such as the surfaces of a printing press, the material 12 is a cloth material. Preferably conventional shop towels used to clean the components of a printing press are used with the device 10.

In other applications not involving cleaning operations, the fabric material 12 can include a metallic mesh material used for sanding or abrading surface. One example of using mesh material with the present invention is the use of the device 10 in sanding the joints of drywall installation. Sandpaper is positioned on the retainer 30 for use of the device 10 in sanding and similar abrading processes. A steel wool pad is also efficiently clamped to the retainer 30. Polishing pads that include sheepskin material or chamois are clamped into position between the retainer 30 and the handle body portion 14.

Figure 4:
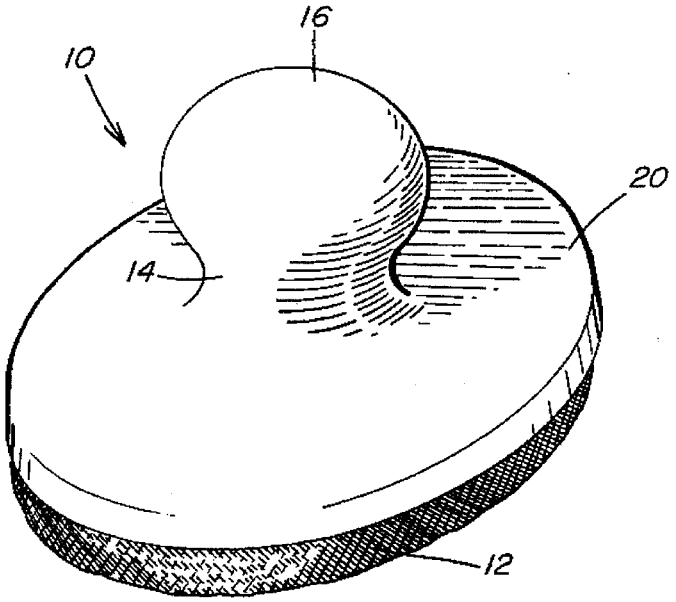
FIG. 4 is an isometric illustration of another embodiment of the handheld cleaning device having a resilient supporting surface for a cleaning cloth.
Figure 9:
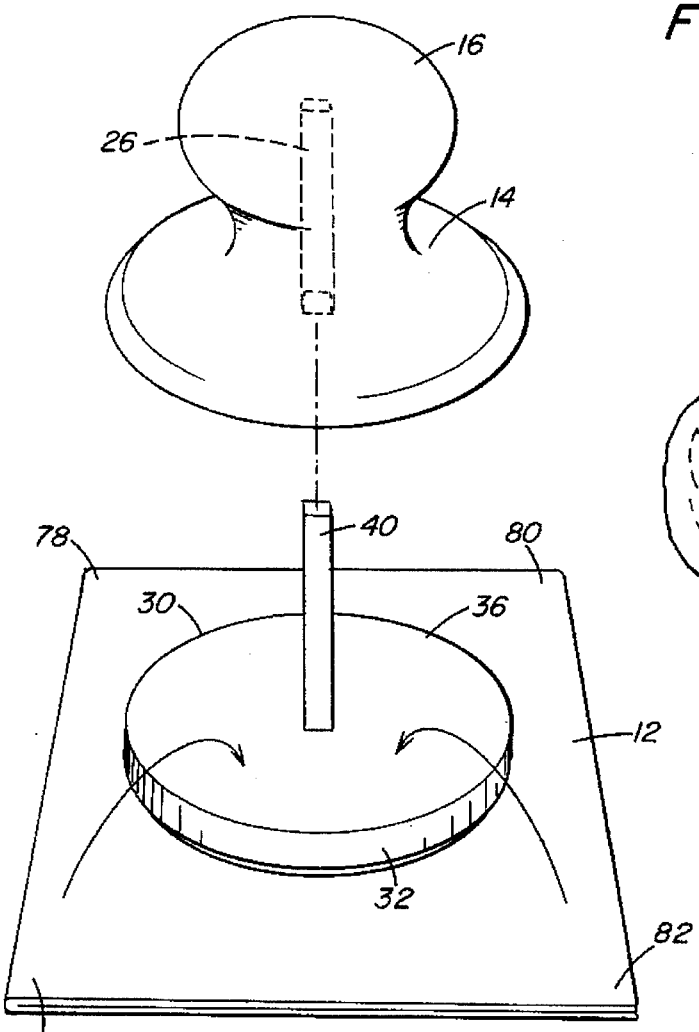
FIG. 9 is a schematic illustration of the initial positioning of a cleaning cloth for clamping on the handheld device.
Figure 10:
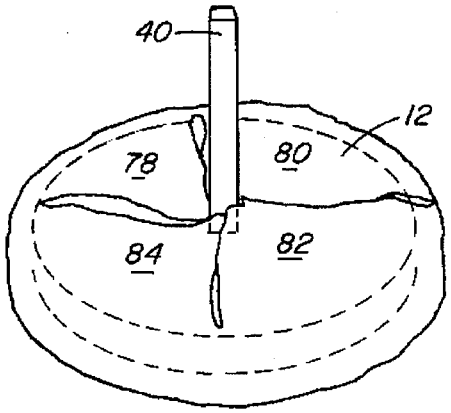
FIG. 10 is a schematic illustration of the cloth folded into position on the supporting surface.
Figure 11:
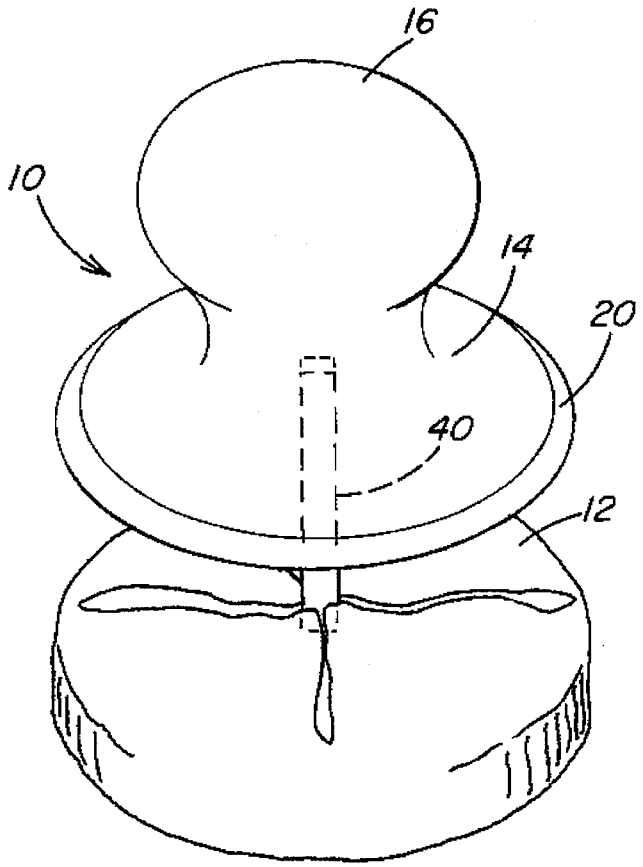
FIG. 11 is a schematic illustration of the cleaning cloth wrapped around the supporting surface and connected to the handle portion of the device.

The sequential operation of positioning the fabric material 12 in position on the retainer 30 is shown in FIGS. 9–12. The embodiment of the retainer 30 shown in FIG. 9 has a circular configuration but it should be understood that the retainer may be square, rectangular, or oblong in shape, as shown in FIGS. 1 and 4. The fabric material 12 shown in FIG. 9 is a conventional shop towel used to clean the stationary and moving parts of a printing press. The towel 12 is first folded in overlapping layers to the desired configuration. The retainer 30 is positioned on the towel 12 with the planar surface 38 in direct contact with the towel 12. The towel corners 78, 80, 82, and 84 are then turned into overlapping relation with the retainer surface 36. FIG. 10 illustrates the positioning of the towel corners 78–84 overlapping the retainer surface 36 and surrounding the ratchet bar 40.

With the towel 12 folded in the manner as illustrated in FIG. 10 around the retainer 30, the retainer 30 is positioned oppositely of the handle body portion 14 to align the bar 40 with the opening to the recess 26 as shown in FIG. 1. With the towel 12 held in a folded position around the retainer 30, the ratchet bar 40 is advanced linearly in a non-rotational manner into the recess 26 until the pawl 48 engages the ratchet teeth 42. Once the pawl 48 engages the ratchet teeth 42, the retainer 30 cannot be inadvertently separated from the handle body portion 14. The retainer 30 is held in a fixed position opposite the handle body portion 14.

Figure 12:
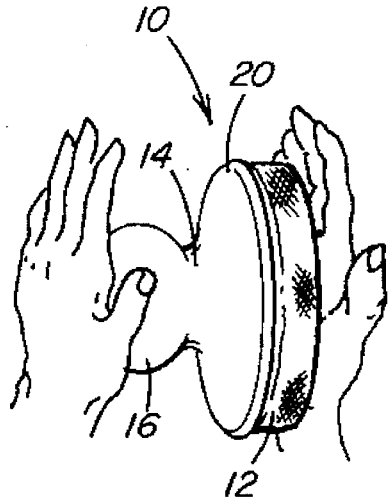
FIG. 12 is a schematic illustration of the manner in which the movable parts of the handheld cleaning device are efficiently connected to one another to clamp the cleaning cloth securely in position.

As schematically illustrated in FIG. 12 with one hand on the handle portion 16 and the other hand pressing against the retainer 30 the ratchet bar 40 is advanced into the recess 26 in a non-rotational, linear motion. The ratchet bar 40 slides on the pawl 48 to allow movement of the bar 40 into the recess 26. The retainer 30 with the towel wrapped thereon is pressed into engagement with the handle body portion 14 to the point where the overlapped layers of the towel 12 are clamped between the opposing surfaces 24 and 36 as shown in FIGS. 2 and 3.

In the clamped position the edges of the towel 12 are frictionally engaged by the retainer 30 and the handle body portion 14 to securely and tightly wrap the cloth material 12 around the retainer 30 connected to the handle body portion 14. Preferably, the retainer 30 is locked in position on the handle body portion 14 when it can no longer advance into the recess 26. At this point the ratchet bar 40 is securely engaged by the pawl 48.

Figure 5:
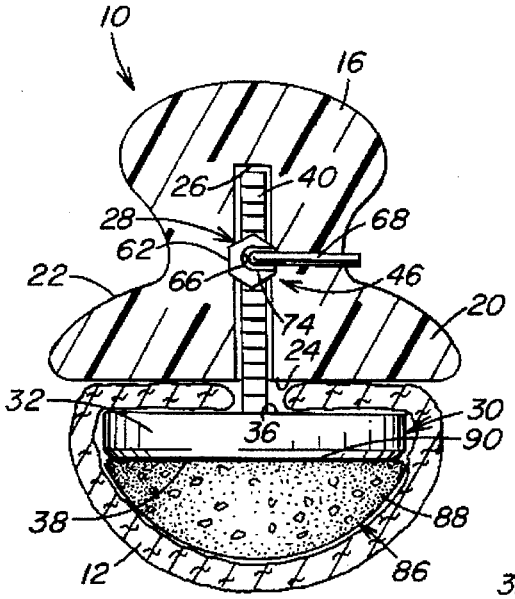
FIG. 5 is a sectional view in side elevation of the embodiment of the cleaning device shown in FIG. 4, illustrating a resilient surface for supporting the cleaning cloth.
Figure 6:
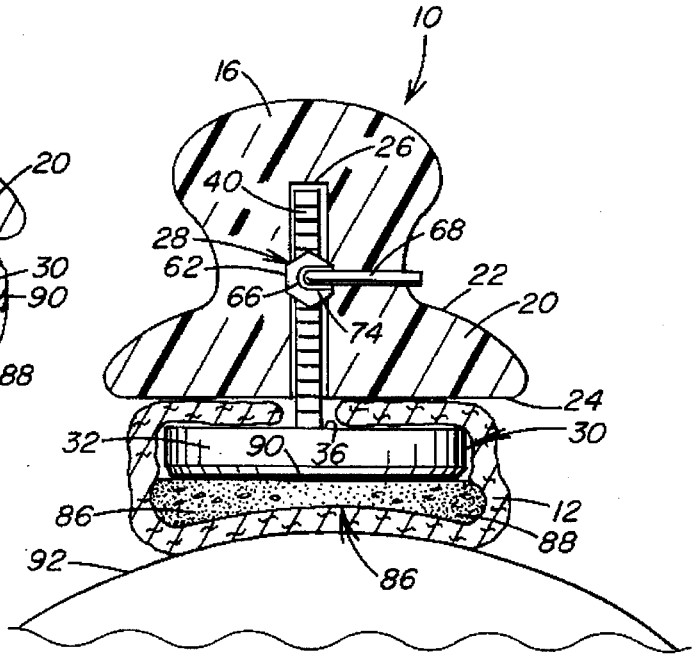
FIG. 6 is a view similar to FIG. 5, illustrating the use of the handheld device to clean a circular machine surface in which the resilient surface is deformable so that the cleaning cloth follows the contour of the surface being cleaned.

Now referring to FIGS. 5 and 6, there is illustrated another embodiment of the handheld device 10 in which the retainer 30 includes a resilient or deformable surface for supporting the fabric material 12. Resilient material generally designated by the numeral 86 is secured by adhesive or the like to the surface 38 of the retainer 30. In one embodiment the resilient material 86 is sponge material having a hemispherical surface 88 extending outwardly from the retainer 30 and a planar surface 90 secured to the retainer planer surface 38. In other embodiments the resilient material 86 includes rubber, plastic, foam material, felt, or any other material having elastomeric properties that permit the material to be deformed upon the application of pressure thereto and capable of returning to its original configuration when the pressure is released.

For example as shown in FIG. 6, the handheld device 10 includes resilient material 86 pressed against the cylindrical surface 92 of a printing press cylinder. In the cleaning operation when the fabric material 12 is pressed against the cylindrical surface 92 the resilient material 86 is compressed and will conform to the configuration of the surface 92. The fabric material 12 follows the deformed configuration of the material 86. In this manner, the towel 12 conforms to the radius of curvature of the cylindrical surface 92 being cleaned. This avoids the point-of-contact cleaning encountered when a rigid flat surface of the retainer 30 supports the fabric material 12 on a cylindrical surface. By conforming the fabric material 12 to the configuration of the cylindrical surface 92 a maximum surface area of the towel 12 is maintained in contact with the surface 92.

Figure 13:
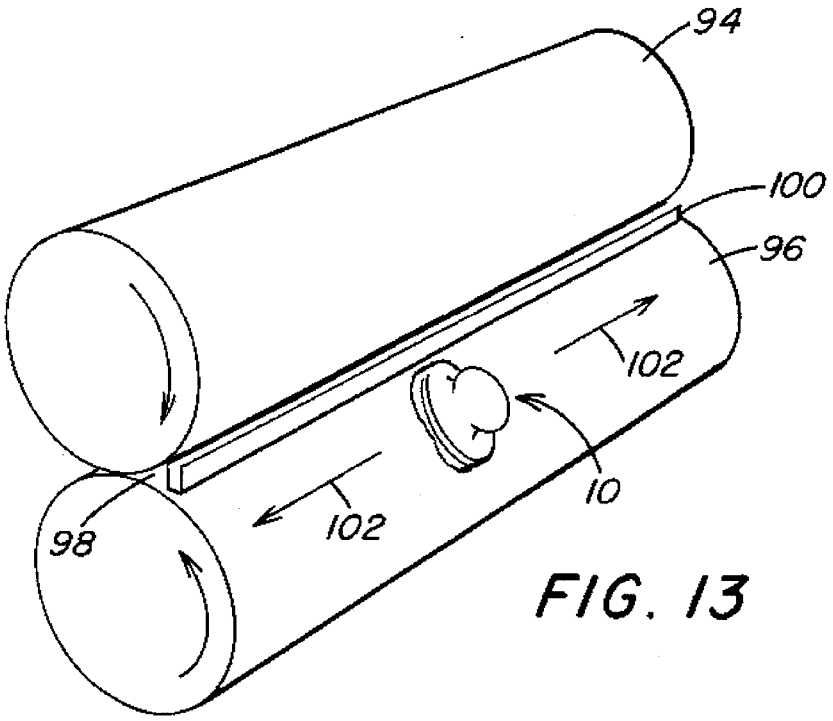
FIG. 13 is a schematic illustration of the manner of using the handheld cleaning device of the present invention to clean the cylinders of a printing press.

The handheld device 10 of the present invention has many applications in cleaning, scouring, abrading, and the like. The device 10 is particularly adapted to cleaning the cylindrical surfaces of printing press cylinders, as illustrated in FIG. 13. As discussed above while automatic blanket washers are known, they are expensive and are limited in use. For example, they are not used to clean plate cylinders. The conventional use of shop towels is preferred in many instances, but interruption of the rotating press components is required before shop towels can be used.

The present invention facilitates the use of conventional shop towels to clean rotating machinery. The machine operation need not be interrupted during cleaning. The handheld device 10 permits the operator to use a conventional shop towel to clean the cylinders of a printing press without requiring the application of OSHA lockout/tagout procedures. The cylinders are cleaned by the device 10 as the cylinders are operated at a reduced speed which is less than production speed. It should be understood that when the press cylinder is cleaned it is operated at a speed no greater than the speed for service functions. The preferred speed is identified in the art as "creep" "crawl" and "inch" speed However, the press does not have to be shut down when cleaned using the device 10. Nor it is required to remove machine guards in order to clean the rotating cylinders.

As schematically illustrated in FIG. 13, a pair of press cylinders 94 and 96 are conventionally supported in a press frame (not shown) for rotation in opposite directions. The cylinders 94 and 96 are positioned in spaced parallel, overlying relation forming a nip 98 therebetween. To prevent injury to operating personnel a nip guard in the form of a bar 100 is supported by the machine frame overlying the nip 98. This prevents the operator's fingers from being caught in the nip 98 or an article of clothing being drawn into the nip 98 by the counter-rotating cylinders 94 and 96.

The handheld device 10 is used to clean the rotating surface of the cylinders 94 and 96 by positioning the desired type of fabric material 12 on the device 10 as described above and illustrated, for example in FIGS. 2 and 3. With the material 12 secured on the retainer 30 and the operator grasping the handle 16 as shown in FIG. 1, the surface of the fabric material 12 is positioned oppositely of the rotating surface of the press cylinder 96. The operator advances the device 10 toward the cylinder 96 until the fabric material 12 contacts the surface of the cylinder 96. As the cylinder 96 rotates at creep, crawl, or inch speed, for example, in a counterclockwise direction the operator traverses the device 10 in a back and forth motion in the direction indicated by the arrows 102 between the opposite ends of the cylinder 96 along the length of the cylinder 96.

Initially, the desired cleaning solution is applied to the fabric material 12 engaged on the retainer 30 secured to the handle body portion 14. With a suitable supply of cleaning solution on the fabric material 12 contact of the material 12 with the surface of the cylinder 96 transfers the cleaning solution from the fabric to the cylinder 96 as the cylinder rotates. The back and forth motion is repeated until the cylinder has made a suitable number of revolutions. The cleaning operation is then repeated for the upper cylinder 94.

Once the cleaning operation is completed, the fabric material 12 containing the cleaning solution is removed from the retainer 30 by releasing the locking mechanism 28 to permit the ratchet bar 40 to be disconnected from the body portion 14. A clean, dry shop towel is then wrapped around the retainer 30 which is then locked into engagement with the handle body portion 14 by the locking mechanism 28. The dry towel is then traversed back and forth the length of the rotating cylinder to dry the cylinder surface.

In both the cleaning and drying operations the fabric material 12 is securely clamped on the handheld device 10. Uniform pressure is applied through the fabric material 12 to the surface being cleaned. This facilitates greater cleaning efficiency because a uniform pressure is applied to a greater surface area than available with conventional hand cleaning.

Also in accordance with the present invention the handheld device 10 can be provided with a cleaning reservoir positioned on the retainer 30 for automatically dispensing the cleaning solution to the fabric material 12. This permits a constant metered amount of cleaning solution delivered to the cleaning fabric.

The handheld device 10 is easily manufactured in a variety of sizes to meet many cleaning and related tasks. For example, the device 10 may be manufactured for a specific press type and size, as well as, to fit the hand size of the individual operator. The usefulness of the handheld device 10 is not limited to cleaning press components. It has application to safely cleaning any machinery wherever there is a risk of injury to the operator.

According to the provisions of the patent statutes, we have explained the principle, referred construction, and mode of operation of our invention and have illustrated and described what we now consider to represent its best embodiments. However, it should be understood that within the scope of the appended claims, the invention may be practiced otherwise as specifically illustrated and described.

We claim:

1. Handheld apparatus for supporting fabric material comprising, a body portion having at one end a handle and at an opposite end an enlarged bearing surface for engaging fabric material, a retainer member positioned oppositely of said bearing surface and having a peripheral surface for supporting the fabric material wrapped around said supporting surface, a bar immovably secured to and extending outwardly from said retainer member, an internal recess extending through said bearing surface into said body portion to receive said bar for nonrotational longitudinal movement of said retainer member toward and away from said bearing surface, locking means extending through said handle into engagement with said bar for restraining movement of said bar out of said recess, said locking means movable into and out of engagement with said bar to permit intermittent advance of said bar into said recess while preventing movement of said bar out of said recess to position said retainer member with a layer of the fabric material wrapped around said peripheral surface into clamping engagement with said body portion bearing surface to secure the fabric material to said body portion, said locking means including said bar having a plurality of ratchet teeth extending in series the length of said bar, a passageway extending through said body portion perpendicular to said recess and intersecting said recess, an actuator retained for nonrotational longitudinal movement in said passageway, said actuator having a pawl at one end portion engageable with said bar ratchet teeth to position said retainer a preselected distance from said bearing surface, biasing means acting on said pawl in said passageway to normally maintain said pawl in engagement with said bar ratchet teeth to allow said bar to advance freely to selected positions in said body portion while locking said bar against unintended movement out of said body portion, means connected to an opposite end portion of said actuator for releasing said locking means from engagement with said bar to allow extension of said bar from said recess, and said means for releasing extending from said housing for movement into and out of position maintaining said pawl in contact with said bar ratchet teeth so that when said pawl is removed from contact with said bar ratchet teeth said body portion moves freely out of said recess to permit extension of said bar for removal of the fabric material from clamping engagement with said body portion.

2. Handheld apparatus for supporting fabric material as set forth in claim 1 which includes, means provided on said handle for grasping said handle by an operator's hand, and an arcuate surface positioned on said body portion between said handle and said retainer member for shielding the operator's hand from contact with the fabric material wrapped around said supporting surface.

3. Handheld apparatus for supporting fabric material as set forth in claim 2 which includes, means positioned on said body portion for preventing the operator's hand from extending beyond said handle.

4. Handheld apparatus for supporting fabric material as set forth in claim 1 in which, said means for releasing said locking means from engagement with said bar includes a lever connected to said locking means and extending out of said passageway from said handle, and said lever movable between a first position maintaining said locking means in engagement with said bar to retain said bar in said recess and a second position releasing said locking means from engagement with said bar to permit unobstructed movement of said bar out of said recess.

5. Handheld apparatus for supporting fabric material as set forth in claim 1, in which, said locking means restrains said bar from moving out of said recess when a force is applied to move said retainer member away from said body portion, and said locking means is releasable from engagement with said bar to permit nonrotational linear advancement of said bar in said recess when a force is applied to move said retainer member toward said body portion.

6. Handheld apparatus for supporting fabric material as set forth in claim 1 in which, said biasing means includes a spring compressed between said actuator and said pawl to normally urge said pawl into engagement with said ratchet teeth to allow movement of said bar into said body portion and restrain movement of said bar out of said body portion, and said means for releasing said locking means including a lever connected to said actuator and extending out of said passageway for compressing said spring to move said pawl out of engagement with said ratchet teeth to allow unrestrained movement of said bar out of said body portion.

7. Handheld apparatus for supporting fabric material as set forth in claim 1 which includes, a shop towel folded around said retainer member, and said bar nonrotatably linearly advanced into said recess until said shop towel is clamped between said body portion bearing surface and said retainer member and said bar is prevented from further advancement into said body portion.

8. Handheld apparatus for supporting fabric material as set forth in claim 1 which includes, resilient material secured to said retainer member peripheral surface for supporting the fabric material on said retainer member for deformation of the fabric material to conform to the contour of a surface of an object pressed against the fabric material.

9. A method for releasably supporting fabric material on a handheld device comprising the steps of, positioning a retainer member oppositely of a bearing surface of a base of a handle member, wrapping fabric material around the retainer member to cover the retainer member, supporting the retainer member on the handle member by a bar having ratchet teeth for non-rotational movement of the retainer member toward and away from the base bearing surface, movably positioning the bar in a recess extending longitudinally into the handle member from an opening in base bearing surface, engaging the bar ratchet teeth by a pawl supported in the handle member for linear movement into and out of engagement with the ratchet teeth, normally biasing the pawl into engagement with the ratchet teeth to allow nonrotational linear movement of the bar into the handle member and restrain movement of the bar out of the handle member, intermittently advancing the retainer member to selected positions opposite the base bearing surface, locking the retainer member in selected positions opposite the base bearing surface, advancing the retainer member with the fabric material wrapped therearound into contact with the base bearing surface to clamp the fabric material between the retainer member and the base bearing surface to secure the fabric material to the handle, locking the pawl in the handle member removed from engagement with the ratchet teeth to permit movement of the bar out of the handle member, and releasing the retainer member from locking engagement with the base to permit removal and replacement of the fabric material on the retainer member.

10. A method as set forth in claim 9 which includes, advancing the retainer member in a continuous linear motion toward the base bearing surface to secure the fabric material to the handle, and restraining movement of the retainer member away from the base bearing surface when the retainer member is located at selected positions opposite the base bearing surface.

11. A method as set forth in claim 9 which includes, wrapping a shop towel around the retainer member, clamping the shop towel between the base bearing surface and the retainer member, and resiliently supporting the shop towel on the retainer member to allow deformation of the shop towel to conform to the surface contour of an object cleaned by the shop towel.

12. A method as set forth in claim 9 which includes, wrapping an abrading fabric around the retainer member, clamping the abrading fabric between the base bearing surface and the retainer member to secure the abrading fabric on the retainer member secured to the handle member, and grasping the handle member to move the abrading fabric in contact with the surface of an object for abrading.

13. A method for cleaning a rotating cylinder of a printing press comprising the steps of, wrapping cleaning fabric around a retainer member having a peripheral surface for receiving and supporting the cleaning fabric, positioning the retainer member with the cleaning fabric wrapped therearound opposite a handheld support member, securing the retainer member in engagement with the support member by a bar having ratchet teeth, movably positioning the bar in a recess extending longitudinally into the support member from an opening in the support member, engaging the bar ratchet teeth by a pawl supported in the support member for intermittently, nonrotatably advancing the retainer member toward the support member into successive locked positions on the support member, normally biasing the pawl into engagement with the ratchet teeth to allow nonrotational linear movement of the bar into the support member, restraining movement of the retainer member in a direction away from and out of engagement with the support member, moving the retainer member to a selected position opposite the support member where the cleaning fabric is fictionally engaged between the retainer member and the support member so that the cleaning fabric is securely clamped to the retainer member and the support member, applying a cleaning solution to the cleaning fabric wrapped around the retainer member, holding the support member to position the cleaning fabric wrapped around the retainer member oppositely of a rotating cylinder of a printing press, contacting the cleaning fabric with the surface of the rotating cylinder, moving the support member along the longitudinal length of the rotating cylinder while maintaining the cleaning fabric in contact with the rotating cylinder, and traversing the support member in a back and forth motion between opposite ends of the cylinder to transfer the cleaning solution from the cleaning fabric to the surface of the cylinder as the cylinder rotates.

14. A method as set forth in claim 13 which includes, resiliently supporting the cleaning fabric on the peripheral surface of the retainer member, contacting the cleaning fabric with the surface of the printing press cylinder, and pressing the resiliently supported cleaning fabric wrapped around the retainer member against the printing press cylinder to conform the cleaning fabric to the curvature of the surface of the cylinder to increase the area of contact of the cleaning fabric with the surface of the cylinder.

15. A method as set forth in claim 13 which includes, locking the retainer member with the cleaning fabric wrapped therearound in a preselected position on the support member, and adjusting the position of the retainer member on the support member by nonrotational linear movement of the retainer member.

16. A method as set forth in claim 13 which includes, advancing the retainer member on the support member to clamp the cleaning fabric thereto by applying a force to the support member to advance the retainer member in a continuous nonrotational movement.

* * * * *